US005868007A

United States Patent [19]

Higginbotham

[11] Patent Number: 5,868,007

[45] Date of Patent: Feb. 9, 1999

[54] AIR SEPARATION

[75] Inventor: Paul Higginbotham, Guildford, England

[73] Assignee: The BOC Group plc, Windlesham, England

[21] Appl. No.: 934,102

[22] Filed: Sep. 19, 1997

[30] Foreign Application Priority Data

Sep. 20, 1996 [GB] United Kingdom ..... 9619718

[51] Int. Cl.[6] ..... F25J 3/00

[52] U.S. Cl. ..... 62/654; 62/903; 62/924

[58] Field of Search ..... 62/654, 903, 924

[56] References Cited

U.S. PATENT DOCUMENTS

| | | | |
|---|---|---|---|
| 5,341,647 | 8/1994 | Koeberle et al. | 62/654 |
| 5,428,962 | 7/1995 | Rieth | 62/653 |
| 5,471,842 | 12/1995 | Mostello et al. | 62/653 |

FOREIGN PATENT DOCUMENTS

| | | |
|---|---|---|
| 0 633 438 | 11/1995 | European Pat. Off. . |
| 0 694 745 A1 | 1/1996 | European Pat. Off. . |
| 0 717 249 | 6/1996 | European Pat. Off. . |
| 0 733 869 | 12/1996 | European Pat. Off. . |

*Primary Examiner*—Ronald Capossela
*Attorney, Agent, or Firm*—David M. Rosenblum; Salvatore P. Pace

[57] ABSTRACT

Air is separated in an arrangement of rectification columns including a double rectification column for separating oxygen and nitrogen from the air. The double rectification column comprises a higher pressure rectification column and a lower pressure rectification column. There is in addition a side rectification column for separating argon from a stream of argon-enriched oxygen/vapour withdrawn from the lower pressure rectification column. An intermediate pressure rectification column is employed to separate further nitrogen (oxygen-depleted vapour) from the air. An upward flow of vapour through the intermediate pressure rectification column is created by operation of a reboiler to boil liquid in the bottom of the column. In addition a flow of vaporised air is introduced into an intermediate mass transfer region of the column. For example, a stream of liquid air is withdrawn from an intermediate region of the higher pressure rectification column, is vaporised in a condenser and is introduced into the column through an inlet.

17 Claims, 2 Drawing Sheets

AIR SEPARATION

BACKGROUND OF THE INVENTION

This invention relates to a method and apparatus for separating air.

The most important method commercially for separating air is by rectification. In such a method there are typically performed steps of compressing and purifying the air, fractionating the compressed, purified, air in a higher pressure rectification column, condensing nitrogen vapour separated in the higher pressure rectification column, employing a first stream of resulting condensate as reflux in the higher pressure rectification column, and a second stream of the resulting condensate as reflux in a lower pressure rectification column, withdrawing an oxygen-enriched liquid air stream from the higher pressure rectification column, introducing an oxygen-enriched vaporous air stream into the lower pressure rectification column, and separating the oxygen-enriched vaporous air stream therein into oxygen-rich and nitrogen-rich fractions. The condensation of nitrogen is effected by indirect heat exchange with boiling oxygen-rich liquid fraction in the bottom of the lower pressure rectification column.

The purification of the air is performed so as to remove impurities of relatively low volatility, particularly water vapour and carbon dioxide. If desired, hydrocarbons may also be removed.

At least a part of the oxygen-enriched liquid air which is withdrawn from the higher pressure rectification column is typically partially or completely vaporised so as to form the vaporous oxygen-enriched air stream which is introduced into the lower pressure rectification column.

A local maximum concentration of argon is created at an intermediate level of the lower pressure rectification column beneath the level at which the vaporous oxygen-enriched air stream is introduced. If it is desired to produce an argon product, a stream of argon-enriched oxygen vapour is taken from a vicinity of the lower pressure rectification column below the oxygen-enriched vaporous air inlet where argon concentration is typically in the range of 5 to 15% by volume, and is introduced into a bottom region of the side rectification column in which an argon product is separated therefrom. The side column has a condenser at its head from which a reflux flow for the side column can be taken. The condenser is cooled by a part or all of the oxygen-enriched liquid air withdrawn from the higher pressure rectification column, the oxygen-enriched liquid air thereby being vaporised. Such a process is illustrated in EP-A-377 117.

The rectification columns are sometimes required to separate a second liquid feed air stream in addition to the first vaporous feed air stream. Such a second liquid air stream is used when an oxygen product is withdrawn from a lower pressure rectification column in liquid state, is pressurised, and is vaporised by heat exchange with incoming air so as to form an elevated pressure oxygen product in gaseous state. A liquid air feed is also typically employed in the event that one or both the oxygen and nitrogen products of the lower pressure rectification column are taken at least in part in liquid state. Employing a liquid air feed stream tends to reduce the amount of liquid nitrogen reflux available to the rectification, particularly, for example, if a liquid nitrogen product is taken. If an argon product is produced there is typically a need for enhanced reflux in the lower pressure rectification column in order to achieve a high argon recovery. The relative amount of liquid nitrogen reflux may also be reduced by introducing vaporous feed air into the lower pressure rectification column (in which example nitrogen cannot be separated from this air in the higher pressure rectification column and is therefore not available for condensation) or by withdrawing a gaseous nitrogen product from the higher pressure rectification column, not only when liquid products are produced but also when all the oxygen and nitrogen products are withdrawn in gaseous state from the rectification columns. There may therefore be a difficulty in obtaining a high argon recovery in, for example, any of the circumstances outlined above, particularly if a liquid nitrogen or liquid oxygen product is produced. Accordingly, it may be necessary, for example, to sacrifice either production or purity of liquid products (including liquid product streams that are vaporised downstream of their exit from the rectification columns) and any gaseous nitrogen product that is taken from the higher pressure rectification column or recovery of argon.

SUMMARY OF THE INVENTION

According to the present invention there is provided a method of separating air comprising forming oxygen-rich and nitrogen-rich fractions in a double rectification column comprising a higher pressure rectification column, into which a flow of vaporous air is introduced, and a lower pressure rectification column, and separating in a first side rectification column an argon-rich vapour fraction from a first argon-enriched vapour stream withdrawn from the lower pressure rectification column, wherein an oxygen-depleted vapour is formed in an intermediate pressure rectification column operating at a pressure less than the pressure at the top of the higher pressure rectification column and greater than the pressure at the top of the bottom of the lower pressure rectification column, a flow of the oxygen-depleted vapour is condensed, a stream of oxygen-enriched liquid is withdrawn from the intermediate pressure rectification column, is at least partially vaporised, and is introduced into the lower pressure rectification column, a vapour flow up the intermediate pressure rectification column is created, a first stream of liquid air is introduced into an intermediate mass exchange region of the intermediate pressure rectification column, and at least part of the first stream of liquid air is reboiled upstream of its introduction into the intermediate pressure rectification column or a second stream of liquid air is withdrawn from the same or a different intermediate mass exchange region of the intermediate pressure rectification column from that into which the first stream of liquid air is introduced and is reboiled, the resulting vapour being returned to the intermediate pressure rectification column.

The invention also provides apparatus for separating air comprising a double rectification column, which has an outlet for an oxygen-rich fraction and which comprises a higher pressure rectification column, having an inlet for a flow of vaporous air, and a lower pressure rectification column; a first side rectification column, for separating an argon-rich vapour fraction from a first argon-enriched vapour stream, having an inlet for the first-argon enriched vapour stream communicating with the lower pressure rectification column; an intermediate pressure rectification column which, in use, operates at a pressure less than the pressure of the top of the higher pressure rectification column but greater than the pressure at the bottom of the lower pressure rectification column; a first condenser for condensing oxygen-depleted vapour formed, in use, in the intermediate pressure rectification column; at least one vaporiser for vaporising a flow of oxygen-rich liquid from the intermediate pressure rectification column, the vaporiser having an outlet communicating with the lower pressure rectification column; means for providing a flow of vapour up the intermediate pressure rectification column; an inlet to an intermediate mass exchange region of the intermediate pressure rectification column for a first stream of liquid air; and a first reboiler for reboiling at least part of the stream of liquid air upstream of the intermediate pressure rectification column or for reboiling a second stream of liquid air withdrawn from the same or a different intermediate mass exchange region of the intermediate pressure rectification column as the first stream of liquid air, the first reboiler having an outlet communicating with the intermediate pressure rectification column.

The method and apparatus according to the invention, at least in preferred examples, make it possible in comparison with a comparable conventional method and apparatus to reduce this specific power consumption, to increase the argon yield, and to increase the yield of the oxygen-rich fraction. In addition, when liquid products are produced, the ratio of liquid oxygen and/or liquid nitrogen product to the total production of oxygen product may be increased.

There are a number of different factors which would contribute to this advantage. In particular, the intermediate pressure rectification column enhances the rate at which liquid reflux can be made available to the lower pressure rectification column (in comparison with the method according to EP-A-0 377 117) and thereby makes it possible to ameliorate the problem identified above thus, a stream of the condensed oxygen-depleted vapour is preferably introduced into the lower pressure rectification column. Alternatively, or in addition, the stream of the condensed oxygen-depleted vapour may be taken as product, particularly if it contains less than 1% by volume of oxygen.

Although it is possible to introduce a stream of vaporous feed air into a bottom region of the intermediate pressure rectification column so as to provide the upward vapour flow therethrough, it is preferred to employ a second reboiler for this purpose. Preferably, a flow of oxygen-enriched liquid air is vaporised at least in part in the second reboiler by indirect heat exchange preferably with one or more of the following streams:

(a) a stream of nitrogen separated in the higher pressure rectification column;

(b) a stream of vapour withdrawn from the same region of the lower pressure rectification column as that from which the first argon-enriched vapour stream is withdrawn;

(c) a stream of oxygen-enriched vapour withdrawn from a region of the lower pressure rectification column above the region from which the first argon-enriched vapour stream is withdrawn but below that at which the at least partially vaporised stream of oxygen-enriched liquid taken from the intermediate pressure rectification column is introduced;

(d) a stream of vapour withdrawn from the first side rectification column, particularly from an intermediate mass exchange region thereof;

(e) a stream of vapour separated in a second side rectification column which is fed with a stream of oxygen vapour having an oxygen mole fraction of at least 0.99 or a second stream of argon-enriched vapour which is withdrawn from the lower pressure rectification column or the first side rectification column.

In each of the examples (a) to (e) above, the vapour stream which is heat exchanged with the reboiling liquid is typically condensed thereby. In examples (b) to (d), a stream of the resulting condensate is preferably returned to the region from which the vapour was taken upstream of its condensation. In example (e) the second stream of argon-enriched vapour is preferably taken from the same region of the lower pressure rectification column as the first stream of argon-rich vapour, part of the condensed vapour formed in the second side rectification column employed as reflux therein, and another part the vapour taken from upstream or downstream of the condensation and sent to an intermediate mass exchange region of the first side rectification column. If, however, the feed to the second side rectification column is the stream of oxygen vapour, a part of the condensate is employed as reflux in the second side rectification column and another part of the condensate is preferably sent to the same region of the lower pressure rectification column as that from which the first argon-enriched vapour stream is withdrawn.

In examples (b) to (e), a "pinch" at the region where the at least partially vaporised oxygen-enriched liquid is introduced into the lower pressure rectification column can be arranged to be at a higher oxygen concentration than the equivalent point in a comparable conventional process in which the intermediate pressure rectification column is omitted. Accordingly, the liquid-vapour ratio in the section of the lower pressure rectification column extending immediately above the region from which the first argon-enriched vapour stream is taken can be made greater than in the conventional process. Therefore, the feed rate to the first side rectification column can be increased. It is thus possible to reduce the concentration of argon in the vapour feed to the first side rectification column (in comparison with the comparable conventional process) without reducing argon recovery. A consequence of this is that the lower pressure rectification column needs less reboiler to achieve a given argon recovery. Thus, for example, the rate of production or the purity of a liquid product from the lower pressure rectification column or the rate of production of a gaseous nitrogen product from the higher pressure rectification column may be enhanced. In another example, the rate of production and purity or the oxygen product or products may be maintained, but the rate at which vaporous air is fed from an expansion turbine into the lower pressure rectification column may be increased, thereby making possible an overall reduction in the power consumed.

Preferably, the second reboiler receives for reboiling a flow of oxygen-enriched liquid air from the bottom of the intermediate pressure rectification column. If so, a stream of an oxygen-enriched liquid air is typically withdrawn from the bottom of the higher pressure rectification column, is reduced in pressure, for example, by being flashed through a throttling valve, and is fed to the intermediate pressure rectification column. In an alternative arrangement, the liquid that is reboiled in the second rectification column is a stream of an oxygen-enriched liquid air which is withdrawn from the bottom of the higher pressure rectification column and is reduced in pressure, for example, by being flashed through a throttling valve. The resulting vaporised oxygen-enriched air is introduced into the bottom of the intermediate pressure rectification column in such an arrangement.

The stream of liquid air which is introduced into the chosen intermediate region of the intermediate pressure rectification column need not have precisely the same composition as air and in particular may have either a higher or a lower oxygen mole fraction. If desired, this liquid stream may be taken directly from a source of liquefied feed air, or may be taken from an intermediate mass exchange region of the higher pressure rectification column or the lower pressure rectification column.

Preferably, the reboiling in the first reboiler of the first or second stream of liquid air is effected by indirect heat exchange with a stream of argon-rich vapour separated in the first side rectification column. In preferred arrangements according to the present invention, two separate condensers are employed for the purpose of condensing the argon-rich vapour, one being that cooled by the first or second stream of liquid air, the other being cooled by a stream of oxygen-enriched liquid air withdrawn from the bottom of the intermediate pressure rectification column and thereby functioning as a said vaporiser.

The oxygen-depleted vapour is preferably condensed in indirect heat exchange with a stream of oxygen-enriched liquid air withdrawn from the bottom of the intermediate pressure rectification column. The condenser in which the heat exchange is performed therefore functions as another vaporiser for vaporising the oxygen-enriched liquid air.

The term "rectification column", as used herein, means a distillation or fractionation column, zone or zones, wherein liquid and vapour phases are countercurrently contacted to effect separation of a fluid mixture, as for example, by contacting the vapour and liquid phases on packing elements or a series of vertically spaced trays or plates mounted within the column, zone, or zones. A rectification column may comprise a plurality of zones in separate vessels so as to avoid having a single vessel of undue height. For example, it is known to use a height of packing amounting to 200 theoretical plates in an argon rectification column. If all this packing were housed in a single vessel, the vessel may typically have a height of over 50 meters. It is therefore obviously desirable to construct the argon rectification column in two separate vessels so as to avoid having to employ a single, exceptionally tall, vessel.

The argon-enriched vapour has a mole fraction of argon greater than 0.01.

Any conventional refrigeration system may be employed to meet the refrigeration requirements for the method and apparatus according to the invention. The vaporous air feed to the higher pressure rectification column is preferably taken from a source of compressed air which has been purified by extraction therefrom of water vapour, carbon dioxide, and, if desired, hydrocarbons, and which has been cooled in indirect heat exchange with products of the air separation. Liquefied air feed is preferably formed in an analogous manner.

BRIEF DESCRIPTION OF THE DRAWINGS

The method and apparatus according to the present invention will now be described by way of example with reference to the accompanying drawings, in which.

DETAILED DESCRIPTION OF THE INVENTION

Figure 1:
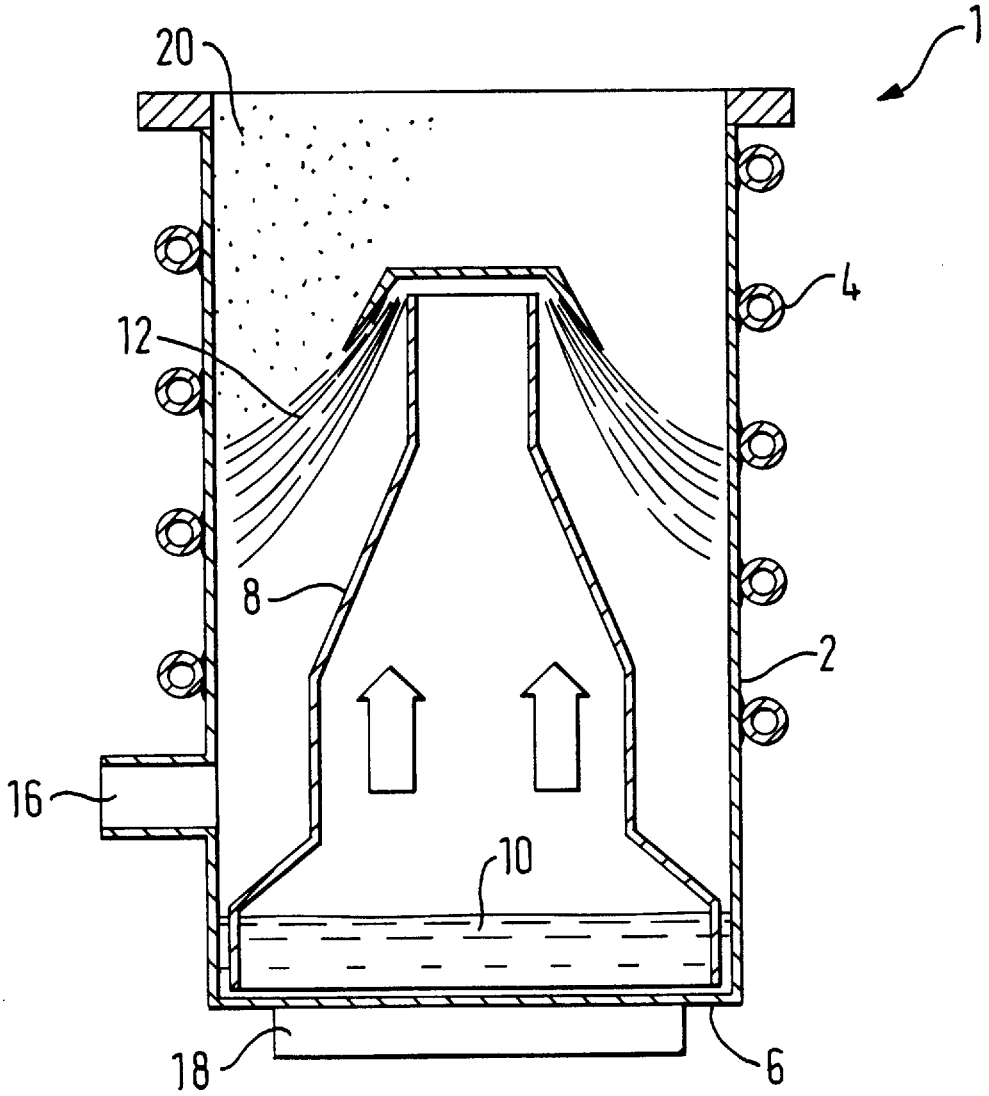
FIG. 1 is a schematic flow diagram of an air separation plant.
Figure 2:
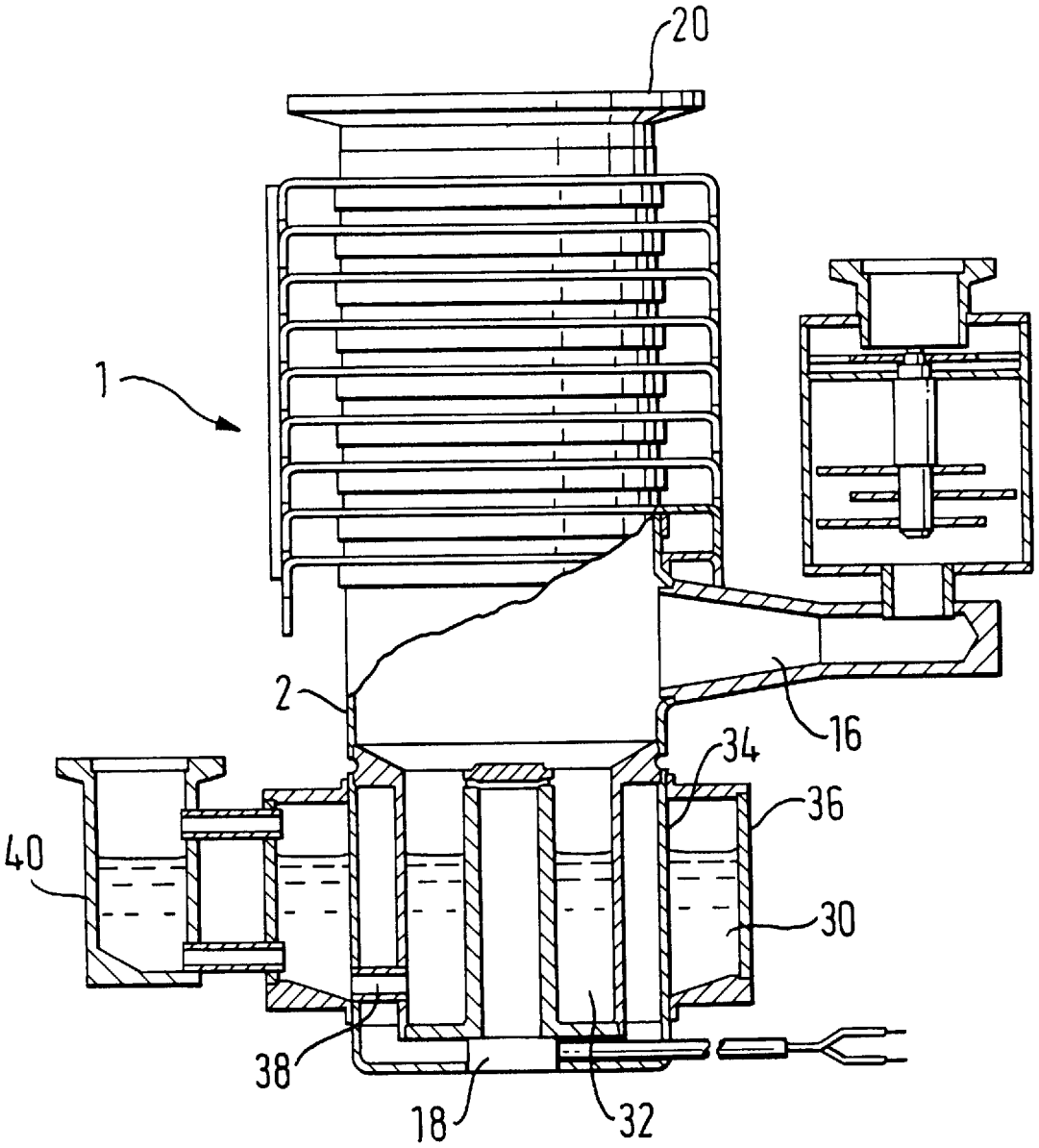
FIG. 2 of the drawings is not to scale.

Referring to FIG. 1 of the drawings, a stream of air is compressed in a compressor 2 typically to a pressure in the order of 5 to 6 bar. Arising heat of compression is removed in a water-cooled after-cooler 4. The compressed air has impurities of relatively low volatility, particularly water vapour, carbon dioxide and hydrocarbons. These impurities are removed therefrom in a conventional purification unit 6. The unit 6 preferably effects the purification either by temperature swing adsorption or pressure swing adsorption. A first flow of the purified air passes through a main heat exchanger 8 from its warm end 10 to its cold end 12. The first flow of purified air is thereby cooled to a temperature suitable for its separation by rectification, i.e. to its saturation temperature or a temperature slightly thereabove. The cooled, purified, first stream of air is introduced into a higher pressure rectification column 14 through an inlet 16. The higher pressure rectification column 14 forms with a lower pressure rectification column 18, a double rectification column 20. In the double rectification column 20, a top region of the higher pressure rectification column 14 is thermally linked to a bottom region of the lower pressure rectification column 18 by a condenser-reboiler 22.

A second stream of purified air is further compressed in a booster-compressor 24. Heat of compression is removed from the compressed air in an aftercooler 26. The resulting stream of further compressed air flows through the main heat exchanger 8 from its warm end 10 to its cold end 12. Downstream of the cold end 12 of the main heat exchanger 8 the second stream of air flows through a throttling valve 28. The air exits the throttling valve 28 at least partially in liquid state and flows into an intermediate mass exchange region of the higher pressure rectification column 14 through an inlet 30.

The higher pressure rectification column 14 contains liquid-vapour contact devices 32 such as distillation trays or packings. The air is separated in the higher pressure rectification column 14 into nitrogen vapour which collects at the top of the column 14 and oxygen-enriched liquid air which collects at the bottom of the column 14. Nitrogen vapour flows from the top of the higher pressure rectification column 14 through condensing passages (not shown) in the condenser-reboiler 22 and is condensed therein. A part of the condensate is returned to the higher pressure rectification column 14 as reflux. Another part of the condensate is sub-cooled by passage through part of the extent of a further heat exchanger 34, is expanded (i.e. reduced in pressure) by passage through a throttling valve 36, and is introduced into the top of the lower pressure rectification column 18, in which rectification column it serves as reflux.

A stream of oxygen-enriched liquid air is withdrawn through an outlet 38 from the bottom of the higher pressure rectification column 14. The stream of oxygen-enriched liquid air is sub-cooled by passage through the part of the extent of the further heat exchanger 34 and is flashed through a throttling valve 40 into a bottom region of an intermediate pressure rectification column 42. A stream of liquid air is withdrawn through an outlet 44 from the same intermediate mass exchange region of the higher pressure rectification column 14 into which the liquid air is fed via the inlet 30. The stream of liquid air withdrawn through the outlet 44 is flashed or expanded through a throttling valve 45 and passes into a vessel 46 in which is located a first reboiler 48 associated with the intermediate pressure rectification column 42. The liquid air is partially reboiled in reboiling passages (not shown) of the first reboiler 48. A stream of the resulting vapour and a stream of the residual liquid are introduced from the vessel 46 into an intermediate mass exchange region of the intermediate pressure rectification column 42 via inlets 50 and 52 respectively. The intermediate pressure rectification column 42 is provided with a second reboiler 54 in a bottom region thereof and with a condenser 56 which has an inlet communicating with the vapour space at the top of the column 42. The second reboiler 54 creates by partial vaporisation of liquid in the bottom of the column 42 a flow of vapour upwardly therethrough. Reflux for the intermediate pressure rectification column 42 is provided by return of condensate from the condenser 56. The flows of air into the intermediate pressure rectification column 42 are separated into a nitrogen vapour that collects at the top of the column 42 and oxygen-enriched liquid air which collects that the bottom of the column 42. The mole fraction of oxygen in the oxygen-enriched liquid air at the bottom of the column 42 is preferably greater than that in the liquid air at the bottom of the higher pressure rectification column 14.

A stream of condensed nitrogen vapour is withdrawn from the condenser 56, is sub-cooled by passage through part of the extent of the further heat exchanger 34, is expanded by passage through a throttling valve 58, and is introduced into the top of the lower pressure rectification column 18, in which rectification column it serves as reflux. A stream of oxygen-enriched liquid is withdrawn from the bottom of the intermediate pressure rectification column 42 through an outlet 60, is flashed through a throttling valve 62, and is divided into two sub-streams. One sub-stream of the oxygen-enriched liquid air is vaporised by indirect heat exchange with nitrogen condensing in the condenser 56. The other sub-stream is vaporised by indirect heat exchange with vapour condensing in a condenser 64. The two vaporised sub-streams of oxygen-enriched liquid air are remixed and introduced into an intermediate region of the lower pressure rectification column 18 through an inlet 66. The vaporisation of the oxygen-enriched liquid air in the condenser 64 is only partial. The vapour that is formed is disengaged from the residual liquid. A stream of residual liquid is withdrawn from the condenser 64 and is introduced through an inlet 68 into the same intermediate region of the lower pressure rectification column 18 as the vapour introduced through the inlet 66.

A further vapour feed to the lower pressure rectification column 18 is formed as follows. A part of the first purified stream of air is taken from upstream of its passage through the main heat exchanger 8 and is compressed in a further booster-compressor 70. Heat of compression is removed from the thus further compressed, purified air in an after-cooler 72. The resulting air flows from the aftercooler 72 through the main heat exchanger 8 from its warm end 10. This stream of air is withdrawn from an intermediate region of the main heat exchanger 8 and is expanded with the performance of external work in an expansion turbine 74 whose outlet exhausts into the lower pressure rectification column 18 via an inlet 76. The external work may consist in the driving of the compressor 70. The inlet 76 may communicate with the same intermediate region of the lower pressure column 18 as the inlets 66 and 68 or may communicate with another intermediate region thereabove.

A further liquid air feed to the lower pressure rectification column 18 is formed by withdrawing a stream of liquid air through an outlet 80 from the same intermediate region of the intermediate pressure rectification column 42 as that with which the inlets 50 and 52 communicate. The stream of liquid air taken from the outlet 80 passes through a throttling valve 82 upstream of its introduction into the lower pressure rectification column 18 through an inlet 84. The inlet 84 communicates with intermediate mass exchange region of the lower pressure rectification column 18 above the one or ones served by the inlets 66 and 76.

The various streams of air that are introduced into the lower pressure rectification column 18 are separated therein into oxygen-rich and nitrogen-rich fractions. Nitrogen vapour flows from the top of the lower pressure rectification column 18 through an outlet 86. Nitrogen vapour passes through the heat exchanger 34 and the main heat exchanger 8 from its cold end 12 to its warm end 10. The nitrogen is thus warmed to approximately ambient temperature. A stream of liquid oxygen is withdrawn from the bottom of the lower pressure rectification column 18 through an outlet 88 by operation of a pump 90 which raises a pressure of the oxygen. The resulting stream of pressurised oxygen flows through the main heat exchanger 8 from its cold end 12 to its warm end 10 and is thereby vaporised in indirect heat exchange with the air streams being cooled therein. A pressurised gaseous oxygen product leaves the warm end 10 of the main heat exchange rate at approximately ambient temperature.

There arises in the lower pressure rectification column a maximum concentration of argon typically in the order of 5 to 15% by volume. At a region of the column below that at which this maximum occurs a stream of argon-enriched oxygen is withdrawn through an outlet 92. The stream of argon-enriched oxygen is introduced into the bottom of a side rectification column 94. A part of the vapour flows upwardly through the column while the remainder passes through the condensing passages (not shown) of the reboiler 54, thereby providing the necessary heat for the vaporisation of oxygen-enriched liquid separated in the intermediate pressure rectification column 42 and thereby itself being condensed in indirect heat exchange with the boiling vapour. The resulting condensate is returned to the bottom of the side rectification column 94.

Separation of argon from oxygen takes place in the side rectification column 94. An argon-rich vapour fraction flows from the top of column 94 and one part of this vapour is condensed in the condenser 48 and the remainder in the condenser 64. It is by indirect heat exchange with the condensing argon that the respective liquid air streams are vaporised in the condensers 48 and 64. A part of the resulting argon condensate is returned to the side rectification column 94 as reflux and another part is taken as product through the outlet 96. Impure liquid oxygen is returned from the bottom of the side rectification column 94 through an outlet 98 to the same intermediate region of the low pressure rectification column 18 from which the argon-enriched vapour is withdrawn.

Typically, the lower pressure rectification column 18, the side rectification column 94 and the intermediate pressure rectification column 42 all contain low pressure drop structured packing in order to effect mass transfer between ascending vapour and descending liquid.

Although not shown in FIG. 1, a nitrogen vapour product may be taken directly from the top of the higher pressure rectification column 14. Additionally or alternatively, one or both of a liquid oxygen or liquid nitrogen product may be taken. If desired, a second expansion turbine (not shown) may be employed so as to provide additional refrigeration to enable liquid products to be taken.

In a typical example of the operation of the plant shown in FIG. 1, the lower pressure rectification column 18 operates at a pressure of about 1.4 bar at its top; higher pressure rectification column 14 operates at a pressure of about 5.5 at its top; the side rectification column 94 operates at a pressure of about 1.3 bar at its top; and the intermediate pressure rectification column 42 operates at a pressure of approximately 2.7 bar at its top.

By employing the reboilers 54 and 64 (rather than a single reboiler 54) the vapour flow in the bottom section of the intermediate pressure rectification column 42 can be reduced with the consequences that less vapour is condensed in the condensing passages of the reboiler 54 and that accordingly the vapour flow upwardly through the side rectification column 94 is increased, thereby increasing the liquid to vapour ratio (if less than 1) provided the rate at which argon product is taken is not changed. As a result fewer stages may be used in the side rectification column 94.

I claim:

1. A method of separating air comprising:

forming oxygen-rich and nitrogen-rich fractions in a double rectification column having a higher pressure rectification column, into which a flow of vaporous air is introduced and a lower pressure rectification column;

separating in a first side rectification column an argon-rich vapour fraction from a first argon-enriched vapour stream withdrawn from the lower pressure rectification column;

forming an oxygen-depleted vapour in an intermediate pressure rectification column operating at a pressure less than the pressure at the top of the higher pressure rectification column and greater than the pressure at the top of the bottom of the lower pressure rectification column;

condensing a flow of the oxygen-depleted vapour;

withdrawing a stream of oxygen-enriched liquid from the intermediate pressure rectification column and at least partially vaporisising said stream of oxygen enriched liquid;

introducing said stream of oxygen-enriched liquid, after having been at least partially vaporized to the lower pressure rectification column;

creating a vapour flow up the intermediate pressure rectification column;

introducing a first stream of liquid air is introduced into an intermediate mass exchange region of the intermediate pressure rectification column; and reboiling one of at least part of the first stream of liquid air upstream of its introduction into the intermediate pressure rectification column and a second stream of liquid air withdrawn from the same or a different intermediate mass exchange region of the intermediate pressure rectification column from that into which the first stream of liquid air is introduced and is reboiled;

returning resulting vapour from the reboiling to the intermediate pressure rectification column.

2. The method as claimed in claim 1, wherein a stream of the condensed oxygen-depleted vapour is introduced into the lower pressure rectification column.

3. The method as claimed in claim 1, wherein the upward flow of vapour through the intermediate pressure rectification column is created by boiling liquid.

4. The method as claimed in claim 1, in which a flow of oxygen-enriched liquid air is vaporised at least in part so as to create the upward flow of vapour through the intermediate pressure rectification column.

5. The method as claimed in claim 4, in which the flow of oxygen-enriched liquid air is taken from the bottom of the intermediate pressure rectification column.

6. The method as claimed in claim 4, in which the flow of oxygen-enriched liquid air is one that has been withdrawn from the bottom of the higher pressure rectification column and has been reduced in pressure.

7. The method as claimed in claim 1, in which a flow of oxygen-enriched liquid is vaporised by indirect heat exchange with at least one stream selected from:

a stream of nitrogen separated in the higher pressure rectification column;

a stream of vapour withdrawn from the same region of the lower pressure rectification column as that from which the first argon-enriched vapour stream is withdrawn;

a stream of oxygen-enriched vapour withdrawn from a region of the lower pressure rectification column above the region from which the first argon-enriched vapour stream is withdrawn but below that at which the at least partially vaporised stream of oxygen-enriched liquid taken from the intermediate pressure rectification column is introduced;

a stream of vapour withdrawn from the first side rectification column, particularly from an intermediate mass exchange region thereof; and a stream of vapour separated in a second side rectification column which is fed with a stream of oxygen vapour having an oxygen mole fraction of at least 0.99 or a second stream of argon-enriched vapour which is withdrawn from the lower pressure rectification column or the first side rectification column;

So as to create the upward flow of vapour through the intermediate pressure rectification column.

8. The method as claimed in claim 7, in which the selected stream is condensed by its indirect heat exchange with the flow of oxygen-enriched liquid air.

9. The method as claimed in claim 1, in which the stream of liquid air which is introduced into the said intermediate region of the intermediate pressure rectification column is taken from a source of liquefied feed air or from an intermediate mass exchange region of the higher pressure rectification column.

10. The method as claimed in claim 1, in which the reboiling of the first or second stream of liquid air is effected by indirect heat exchange with a stream of argon-rich vapour separated in the first side rectification column.

11. An apparatus for separating air comprising:

a double rectification column including an outlet for an oxygen-rich fraction, a higher pressure rectification column, having an inlet for a flow of vaporous air, and a lower pressure rectification column;

a first side rectification column, for separating an argon-rich vapour fraction from a first argon-enriched vapour stream, having an inlet for the first-argon enriched vapour stream communicating with the lower pressure rectification column;

an intermediate pressure rectification column which, in use, operates at a pressure less than the pressure of the top of the higher pressure rectification column but greater than the pressure at the bottom of the lower pressure rectification column;

a first condenser for condensing oxygen-depleted vapour formed, in use, in the intermediate pressure rectification column;

at least one vaporiser for vaporising a flow of oxygen-rich liquid from the intermediate pressure rectification column, the vaporiser having an outlet communicating with the lower pressure rectification column;

means for providing a flow of vapour up the intermediate pressure rectification column;

an inlet to an intermediate mass exchange region of the intermediate pressure rectification column for a first stream of liquid air;

a first reboiler for reboiling one of at least part of the stream of liquid air upstream of the intermediate pressure rectification column and a second stream of liquid air withdrawn from the same or a different intermediate mass exchange region of the intermediate pressure rectification column as the first stream of liquid air, the first reboiler having an outlet communicating with the intermediate pressure rectification column.

12. The apparatus as claimed in claim 11, in which the first condenser has an outlet for condensate communicating with the top of the lower pressure rectification column.

13. The apparatus as claimed in claim 11, in which the means for providing the flow of vapour up the intermediate pressure rectification column is a second reboiler having reboiling passages having an inlet communicating with a bottom region of the intermediate pressure rectification column or with a bottom region of the higher pressure rectification column.

14. The apparatus as claimed in claim 13, in which the second reboiler has condensing passages having an inlet communicating with one of:

a) a top region of the higher pressure rectification column;

b) the same region of the lower pressure rectification column as that with which the inlet to the first side rectification column is associated;

c) a region of the lower pressure rectification column above that with which the inlet to the first side rectification column is associated but below that with which the outlet of the vaporiser is associated;

d) an intermediate mass exchange region of the first side rectification column; and e) the top region of a second side rectification column having an inlet for vapour communicating either with a region of the lower pressure rectification column where the oxygen mole fraction in the vapour phase is, in use, at least 0.99 or where argon-enriched oxygen vapour is present or with a region of the first side rectification column.

15. The apparatus as claimed in claim 11, wherein the said vaporiser comprises one or both of boiling passages in the first condenser and boiling passages in a second condenser whose condensing passages communicate with a top region of the first side rectification column.

16. The apparatus as claimed in claim 11, wherein the inlet to the intermediate mass exchange region of the intermediate pressure rectification column communicates with an outlet from an intermediate mass exchange region of the higher pressure rectification column or with a source of liquefied feed air.

17. The apparatus as claimed in claim 11, in which the higher pressure rectification column has an inlet for liquefied feed air.

* * * * *